US007052171B1

(12) United States Patent
Lefebvre et al.

(10) Patent No.: US 7,052,171 B1
(45) Date of Patent: May 30, 2006

(54) LIGHTING ASSEMBLY WITH SWIVEL END CONNECTORS

(75) Inventors: Phillip E. Lefebvre, Waukesha, WI (US); David Delory Driscoll, Jr., Milwaukee, WI (US)

(73) Assignee: EMTEQ, Inc., Muskego, WI (US)

( * ) Notice: Subject to any disclaimer, the term of this patent is extended or adjusted under 35 U.S.C. 154(b) by 15 days.

(21) Appl. No.: 11/012,628

(22) Filed: Dec. 15, 2004

(51) Int. Cl.
*F21V 21/00* (2006.01)

(52) U.S. Cl. ..... 362/649; 362/640; 362/651; 362/217; 362/249; 439/240

(58) Field of Classification Search ..... 362/640, 362/649, 651, 217, 220, 221, 249, 233; 439/240, 439/239, 241

See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 5,904,415 | A * | 5/1999 | Robertson et al. | 362/260 |
| 6,158,882 | A | 12/2000 | Bischoff, Jr. | |
| 2004/0012959 | A1 | 1/2004 | Robertson et al. | |
| 2005/0162093 | A1 | 7/2005 | Timmermans et al. | |

* cited by examiner

*Primary Examiner*—Laura Tso
(74) *Attorney, Agent, or Firm*—George E. Haas; Quarles & Brady LLP

(57) ABSTRACT

A lighting assembly has an elongated housing which contains a plurality of light emitting diodes that send light from one side of the housing. Connectors at the ends of the housing are provided to connect the lighting assembly into standard sockets of a fluorescent light fixture that has been modified to power the light emitting diodes. At least one of the connectors has a releasable holding mechanism that allows the housing to be rotated with respect to the sockets to aim the light is a desired direction and then hold the housing in that orientation.

36 Claims, 3 Drawing Sheets

LIGHTING ASSEMBLY WITH SWIVEL END CONNECTORS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to light emitting diode assemblies that are useful to illuminate the interior of a vehicle, such as an aircraft, and more particularly to tubular assemblies having a housing that contains a plurality of light emitting diodes.

2. Description of the Related Art

Aircraft cabins have been illuminated by fluorescent lighting systems. The disadvantages of that type of lighting include the relatively short life of the fluorescent lamp, significant weight of the ballast, heat production, generation of radio frequency interference (RFI), and fragility.

One solution to counter the problems identified above has been to use an assembly of light emitting diodes (LED). U.S. Pat. No. 6,158,882 describes an aircraft lighting system which employs a plurality of LED's mounted in a linear array to form a lighting strip. Such a strip can be used to wash a wall or ceiling of the aircraft cabin with light. The electrical power to illuminate the LED's is furnished from a DC power supply that includes a mechanism for adjusting the voltage to control the level of illumination provided by the lighting strip. This enables the light intensity, or brightness to be varied depending upon the outside light level and activity of the passengers. When the aircraft is flying in daylight, the LED lighting strip usually is driven at a voltage level which provides maximum illumination. At nighttime, that maximum illumination level may interfere with the ability of occupants to sleep or see through the plane's windows, especially upon landing. Therefore, a lower interior illumination level is preferred at night.

In addition to incorporating LED strips into new aircraft, it is desirable to retrofit older aircraft with this type of lighting. Many older planes have conventional fluorescent lighting system that uses lamp tubes with a pair of electrical connector pins at each end. Each pair of pins fits into a socket of the light fixture which mechanically holds the fluorescent tube in place, as well as electrically connects the tube to the power source. A fluorescent light fixture can be readily modified to accept an LED lighting strip by removing the ballast and connecting the 110 VAC power from the aircraft directly to the sockets. The LED lighting strip for this application has a full wave rectifier to convert the alternating current into direct current. A sufficient number of light emitting diodes are connected in series so that voltage across each one conforms to the diode's rating.

A standard fluorescent lamp tube is mounted in the light fixture by sliding the connector pins into end sockets and then turning the tube 90° so that the pins engage electrical contacts in the sockets. The fluorescent lamp tube emits light omnidirectionally and its orientation in the sockets is of no consequence. Specifically, it does not matter which pin is inserted first into the socket or the direction that the tube is rotated to make electrical contact. Thus even though the position of the sockets with respect to the cabin walls may vary a fluorescent lamp tube can be used with a different aircraft makes and models.

However, that is not the case for LED lighting strips in which each LED emits light at a narrowly angled conical path. Therefore, a LED lighting tube retrofitted into the existing fluorescent light fixture may not be oriented to emit light in the desired direction within the aircraft. Thus a need exists to be able to adjust the orientation of the LED lighting tube in the sockets of a modified fluorescent lighting system.

SUMMARY OF THE INVENTION

A lighting assembly comprises a housing to which a light source is mounted. In a preferred embodiment, a plurality of light emitting diodes is within the housing and directs light at a relatively narrow angle through a transparent portion of the housing.

A swivel connector is provided to mechanically and electrically connect the lighting assembly to a light fixture. The swivel connector has a rotary fitting attached to the housing, a contact cap adjacent and rotatable with respect to the rotary fitting, and a coupling for engaging a light fixture. A locking member releasably engages at least one of the contact cap and the rotary fitting and a release sleeve operates the locking member to selectively enable and restrict rotation motion between the contact cap and the rotary fitting.

In one embodiment of the present invention, the locking member comprises one or more fingers that project from the contact cap and selectively engage the rotary fitting. The release sleeve has a first position in which it forces each finger against the rotary fitting to create friction that impedes movement between the rotary fitting and the contact cap, thereby maintaining the orientation of the plurality of light emitting diodes with respect to the light fixture. In a second position of the release sleeve, each locking member finger is released from the rotary fitting so that movement may occur between the rotary fitting and the contact cap. This latter position allows the orientation of the LED's to be adjusted.

In another embodiment, the swivel connector has a first torsion spring that winds in one direction around and releasably engages the rotary fitting. The contact cap engages one portion of the first torsion spring and the release sleeve engages another portion of the first torsion spring. The engagement of the first torsion spring with the rotary fitting resists rotation of the housing with respect to the contact cap, thereby holding the orientation of the housing fixed. The release sleeve can be moved with respect to the contact cap to release the holding effect and allow the position of the housing to be changed so that the direction of the emitted light is altered. Specifically, that relative motion loosens the engagement of the first torsion spring with the cylindrical section of the rotary fitting, thereby enabling the housing to rotate with respect to the contact cap.

DETAILED DESCRIPTION OF THE INVENTION

Figures 1, 2:
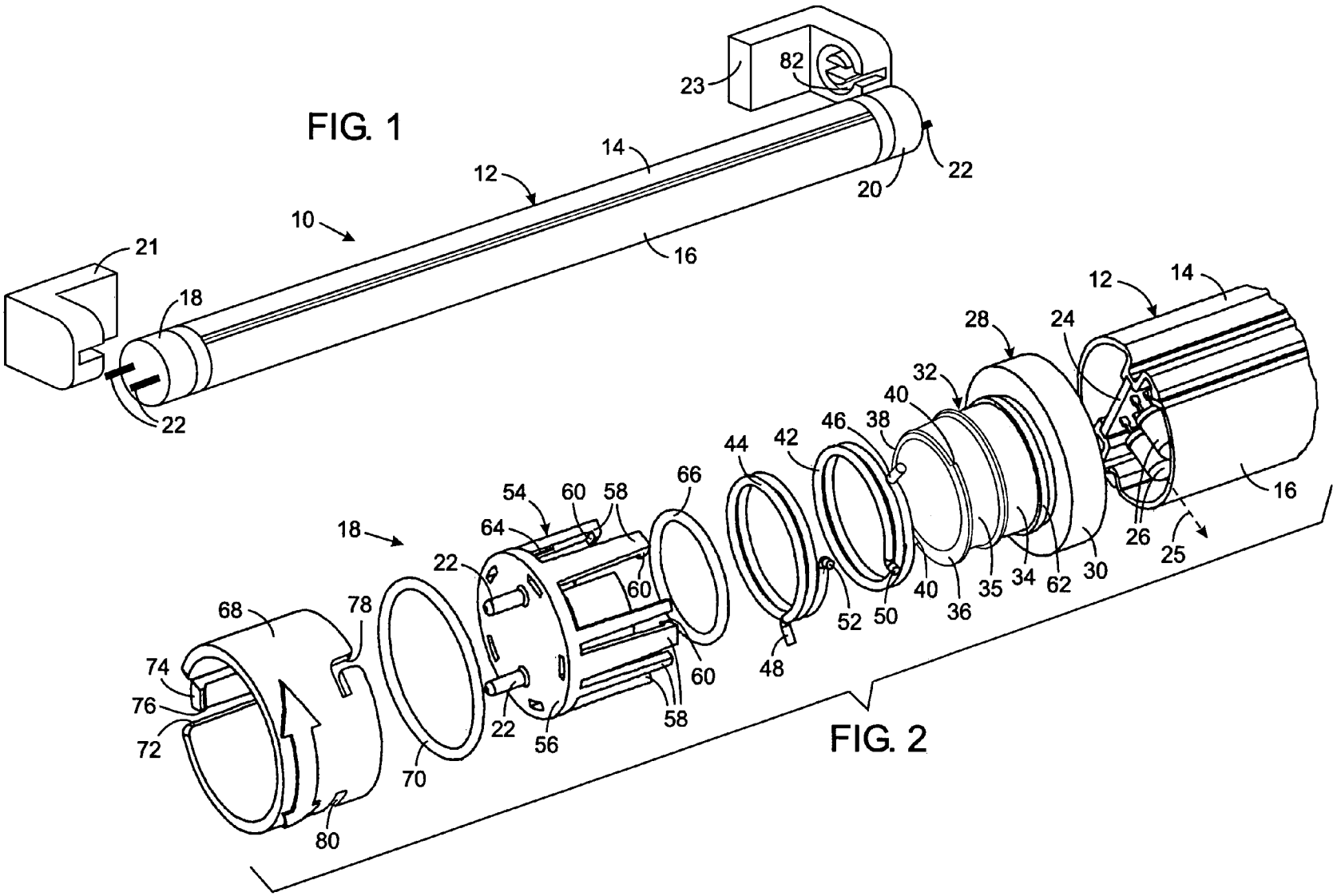
FIG. 1 is an isometric view of a lighting assembly which incorporates the present invention.
FIG. 2 is an exploded view of an end of the lighting assembly showing the components of a swivel electrical connector.

With initial reference to FIG. 1, a first lighting assembly 10 includes an elongated, tubular housing 12 comprising a rigid curved back portion 14 and a curved transparent front portion 16. A pair of connectors 18 and 20 are located at opposite ends of the housing 12 and have pin-type electrical terminals 22 that serve as terminals for making electrical contact with a pair of standard fluorescent tube sockets 21 and 23 between which the first lighting assembly 10 fits. In some versions of the first lighting assembly 10, electricity is supplied through only one end of the housing, in which case the electrical terminals 22 on the connector at the opposite end engage a socket merely to support that end of the housing. The standard fluorescent tube sockets 21 and 23 form a light fixture.

With reference to FIG. 2, the housing 12 contains a circuit board 24 having a plurality of high intensity light emitting diodes (LED's) 26 mounted on one side facing the transparent front portion 16 of the housing. The LED's 26 emit light in a relatively narrow angled conical path centered on axes parallel to line 25.

FIG. 2 further illustrates the details of the first swivel connector 18 which has an adjustable mechanism that holds the light assembly housing 12 in a desired rotational orientation with respect to the mating socket 21. The second swivel connector 20, at the opposite end of the housing 12, has a similar construction except for the holding mechanism, which is optional. The first swivel connector 18 comprises a rotary fitting 28 with a hollow base 30 into which an end of the housing 12 fits and is secured thereto. A hollow cylindrical section 32 projects outwardly from the base 30 of the rotary fitting 28 and has a pair of wide external annular grooves 34 and 35 extending there around. The remote end of the cylindrical section 32 has an annular flange 36 with one semicircular section 38 that has a smaller outer diameter than the other flange section, thereby forming a pair of stops 40 at the interfaces of the two sections. As will be described, these stops 40 limit rotation of the swivel connector 18.

A separate torsion spring 42 and 44 is located in each of the cylindrical section grooves 34 and 35, respectively. In the normal relaxed state, each torsion spring 42 and 44 firmly engages the outer surface of the cylindrical section 32 of the rotary fitting 28. One end of the first torsion spring 42 has a relatively long tab 46 projecting radially outward while the other end of that spring has an outwardly projecting shorter tab 50. Similarly, the second torsion spring 44 has a relatively long tab 48 projecting radially outward at one end and an outwardly projecting shorter tab 52 at the other end. The two torsion springs 42 and 44 have identical construction, however, they are oriented in reversed directions in the grooves 34 and 35 of the rotary fitting 28. That is, the longer tab 46 of the first torsion spring 42 is located closer to the base 30 of the rotary fitting 28 than the shorter tab 50 of that spring. The shorter tab 52 of the second torsion spring 44 is located closer to the base 30 than its longer tab 48. Thus the first and second torsion springs 42 and 44 are wound in opposite directions around the cylindrical section 32.

A contact cap 54 extends over the cylindrical section 32 of the rotary fitting 28 and has a circular base plate 56 across the remote end of the cylindrical section. The circular base plate 56 has a perimeter from which a plurality of fingers 58 project toward the housing 12. The contact cap 54 is able to rotate about the cylindrical section 32 and one of the fingers 58 has an internal ridge 64 that strikes the stops 40 on the outer annular flange 36 of the rotary fitting 28 to limit that rotation to approximately 180 degrees. The widths of the fingers and spacing there between vary as seen the cross sectional view of FIG. 4. Referring again to FIG. 2, the ends of the fingers 58 that are remote from the base plate 56 have inwardly projecting teeth 60. When the contact cap 54 is inserted over the torsion springs 42 and 44 and the cylindrical section 32 of the rotary fitting 28, the teeth 60 snap over an annular rim 62 on the rotary fitting near the base 30. This engagement of the teeth 60 with the annular rim 62 holds the contact cap 54 on the rotary fitting 28 while allowing rotational motion there about. In that assembled state, a resilient first O-ring 66 is compressed between the inside surface of the contact cap base plate 56 and the outer annular flange 36 of the rotary fitting 28. The first O-ring 66 biases the contact cap 54 away from the rotary fitting 28 to ensure a tight engagement between those components.

Two electrical terminals 22 project outwardly from the circular base plate 56 of the rotary fitting 28. The electrical terminals 22 are adapted to mate with a standard socket 21, 23 of a fluorescent light fixture. Wires (not shown) connect the electrical terminals 22 to the circuit board 24 within housing 12 thereby enabling electrical power to be applied to the LED's 26.

Figure 4:
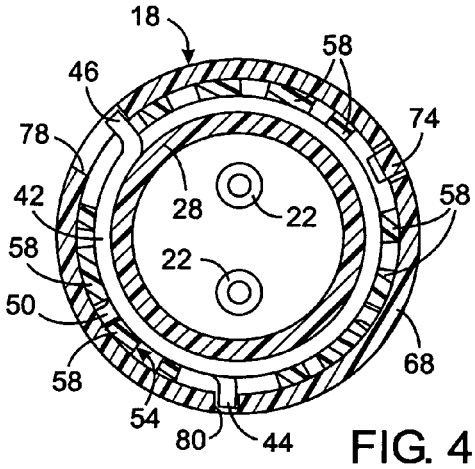
FIG. 4 is a cross section view along line 4—4 of FIG. 3.

With additional reference to FIG. 4, the tabs 46, 48, 50 and 52 of the first and second torsion springs 42 and 44 extend through spaces between the fingers 58 when the contact cap 54 is inserted onto the rotary fitting 28. Because the shorter tabs 50 and 52 are held in relatively narrow slots between the contact cap fingers 58, the firm engagement of the torsion springs 42 and 44 with cylindrical section 32 of the rotary fitting 28 resists rotary motion between the contact cap 54 and the rotary fitting. Thus the orientation of the light assembly housing 12 is held fixed with respect to the light fixture socket 21 into which the electrical terminals 22 are received. The longer torsion spring tabs 46 and 48 project, through those finger spaces, radially outward from the contact cap 54.

Figure 3:
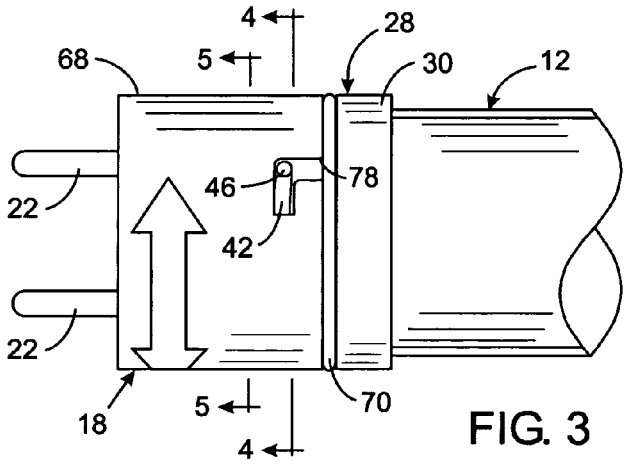
FIG. 3 is a side view of the assembled swivel electrical connector.

A release sleeve 68 extends around the contact cap 54 and the cylindrical section 32 of the rotary fitting 28, as shown in FIG. 3. The release sleeve 68 has a notch 72 with a prong 74 therein. A remote end of the prong 74 is spaced inwardly from release sleeve 68 and includes an inwardly extending catch 76. When the release sleeve 68 is slid over the contact cap 54 during assembly of the first connector 18, the catch 76 snaps into one of the spaces between the contact cap fingers 58 and engages the inner surface of the base plate 56, thereby securing the sleeve onto the contact cap. A resilient second O-ring 70 is compressed between the release sleeve 68 and the base 30 of the rotary fitting 28, as also seen in FIG. 3. Compression of the second O-ring 70 biases the release sleeve 68 away from the rotary fitting 28 to ensure a tight engagement of the release sleeve catch 76 with the contact cap 54. Other kinds of biasing members, such as various types of resilient rings or springs, may be used in place of the first and second O-rings 66 and 70 to ensure a tight engagement of the components of the first connector 18.

Figure 5:
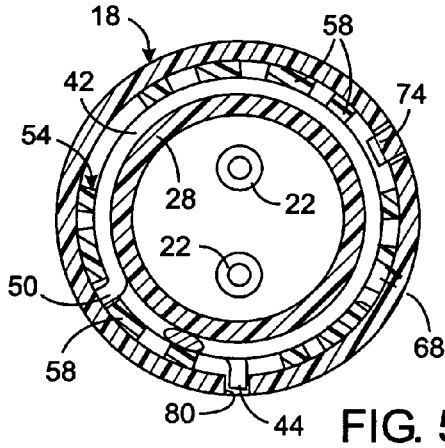
FIG. 5 is a cross section view along line 5—5 of FIG. 3.

The release sleeve 68 has a pair of L-shaped grooves 78 and 80 which respectively receive the longer tabs 46 and 48 of the two torsion springs 42 and 44, as seen in FIGS. 3–5. The two L-shaped grooves 78 and 80 are oriented in different directions on the release sleeve 68. Specifically, the first L-shaped groove 78 has a closed end which is oriented in a clockwise direction around the sleeve when looking at the end of the first lighting assembly 10 and the second L-shaped groove 80 curves in a counterclockwise direction to its closed end. The significance of this reverse orientation of these L-shaped grooves 78 and 80 will be apparent with respect the subsequent description of the operation of the first swivel connector 18.

With reference to FIGS. 2, 4 and 5, the first lighting assembly 10 is adapted to be inserted into sockets 21 and 23 of a conventional fluorescent light fixture which has been modified by removing the ballast and connecting the electrical contacts 82 of the sockets in FIG. 1 directly to the 110 VAC lighting supply circuit for the aircraft. The first lighting assembly 10 is inserted into the sockets 21 and 23 in a conventional manner and turned 90 degrees so that the electrical terminal pins 22 engage socket contacts 82. As noted previously, depending upon the orientation of the light fixture sockets in the aircraft, the light emitting diodes 26 inside the tubular housing 12 may not emit light in the desired direction. However the two swivel connectors 18 and 20 permit the housing 12 to be rotated to aim the light as desired. The first swivel connector 18 contains a releasable mechanism that holds the housing 12 in an electrical orientation with respect to its mating light fixture socket 21. The second swivel connector 20 also allows the housing 12 to pivot with respect to its socket 23, but does not include the position holding mechanism. The second swivel connector 20 may have the same components as the first swivel connector 18, except for the torsion springs 42 and 44 that provide the holding function. Alternatively, the release sleeve 68 and the contact cap 54 of the second swivel connector 20 can be combined into a single piece that snaps onto the rotary fitting 28 and rotates there about.

To change the direction of the light after the first lighting assembly 10 has been inserted in the light fixture sockets 21 and 23, the installer grasps the light assembly housing 12 with one hand and the release sleeve 68 with fingers of the other hand. The release sleeve is then rotated in the opposite direction to the direction at which the tube is to be rotated. For example, rotating the sleeve 68 downward in FIGS. 1 and 2 allows the housing 12 to be freely rotated to direct the emitted light more upward. With reference to FIGS. 3–5, this downward rotation of the release sleeve 68 causes the longer tab 46 of the first torsion spring 42 to be pushed counterclockwise by a wall of the sleeve's first L-shaped groove 78. Because the short tab 50 at the other end of the first torsion spring 42 is securely held within a narrow slot between two fingers 58 of the contact cap 54 (see FIG. 5), this release sleeve motion moves the larger tab 46 toward the shorter tab 50. That relative movement between those tabs expands the inner diameter of the first torsion spring 42 so that it no longer firmly engages the bottom surface of the first groove 34 on the rotary fitting 28. Note that the second L-shaped groove 80 in the release sleeve 68 is oriented in the opposite direction to the first L-shaped groove 78. Therefore, the downward motion of the release sleeve 68 does not apply force to the longer tab 48 on that second torsion spring 44, but rather the curved portion of the second L-shaped groove 80 merely moves past that longer tab. Because that second torsion spring 44 winds around the rotary fitting 28 in the opposite direction to that of the first torsion spring 42, in this relaxed state of the first connector 18, the tubular housing 12 and the rotary fitting 28 may be rotated with respect to the contact cap 54, as such motion tends to expand the second torsion spring 44. Therefore the second torsion spring does not provide significant resistance to the upward rotation the housing 12.

While the first connector 18 is in the released state, the light assembly housing 12 can be rotated with respect to the contact cap 54 to aim the LED's 26 in the proper direction. Engagement of the electrical terminals 22 with the light fixture socket 21 holds the contact cap in a fixed position while the light assembly housing is rotated to aim the LED's.

Once the light assembly housing 12 has been positioned to direct light as desired, the installer loosens the grip on the release sleeve 68, allowing that release sleeve to return to the original relaxed state in which both torsion springs 42 and 44 again firmly engage the grooves 34 and 35 of the rotary fitting 28. This engagement holds the orientation of the housing 12 with respect to the contact cap 54 and the light fixture socket 21 so that the LED's 26 emit light in the desired direction.

To change the orientation of the housing 12 so that the light is directed more downward, the installer rotates the release sleeve 68 in the upward direction. This movement of the release sleeve 68 loosens the second torsion spring 44 in a similar manner to that just described with respect to the opposite motion relaxing the first torsion spring 42. Once the second torsion spring 44 has been relaxed, the light assembly housing 12 can be rotated downward. Once properly aimed, the installer loosens the grip on the release sleeve 68, allowing the second torsion spring 44 to again tighten around the cylindrical section 32 of the rotary fitting 28, thereby holding the housing 12 in the new position.

Depending upon the amount of spring force required to secure the light assembly housing 12 with respect to the contact cap 54, a single torsion spring in the swivel connector 18 may be sufficient. Should a greater amount of force be required than can be provided by two torsion springs, the holding mechanism with torsion springs also can be incorporated in the second swivel connector 20 of the first lighting assembly 10.

Figure 6:
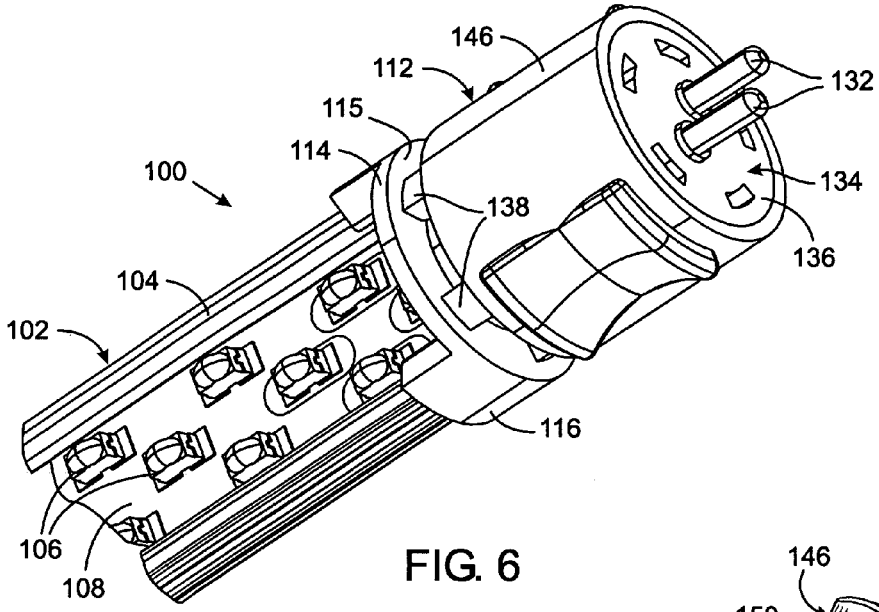
FIG. 6 is an isometric view of an end of a second lighting assembly according to the present invention.
Figure 7:
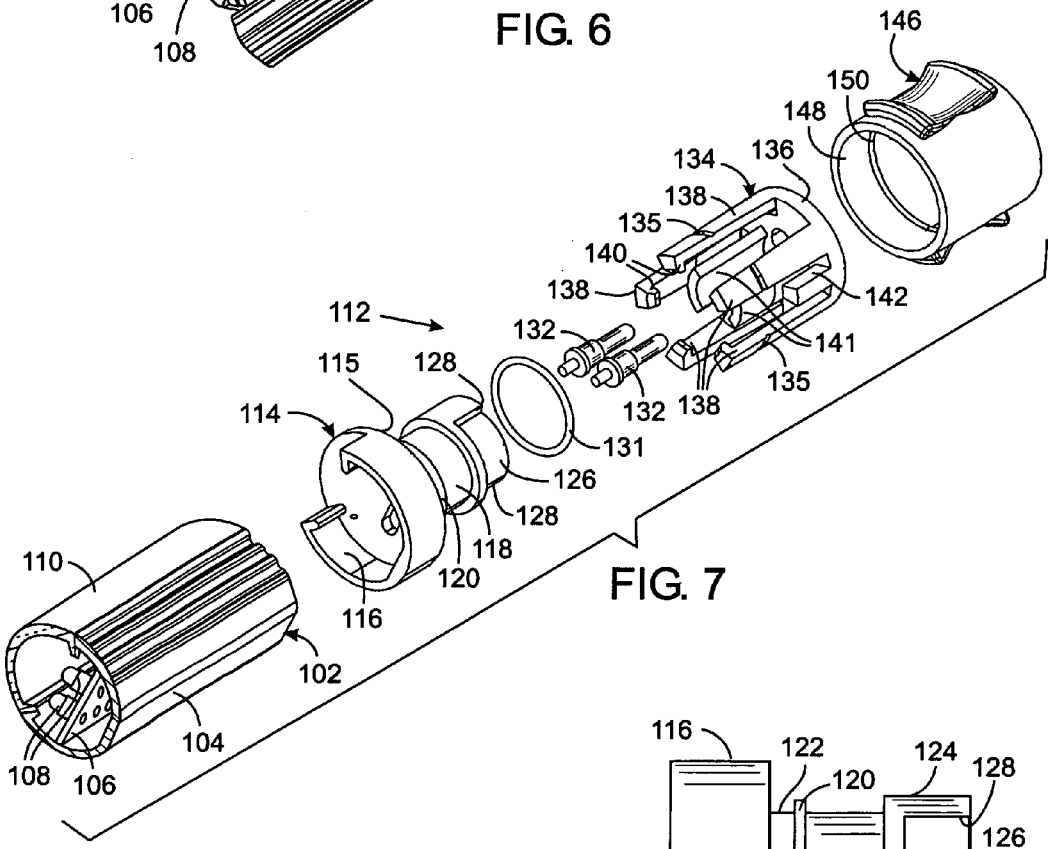
FIG. 7 is an exploded view of the end of the second lighting assembly showing the components of a swivel electrical connector.
Figure 8:
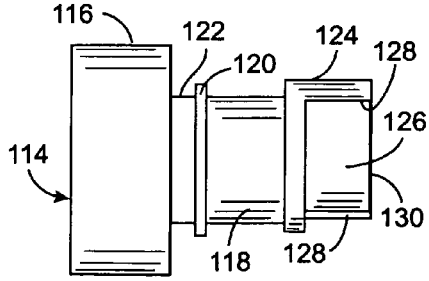
FIG. 8 is a side view of a rotary fitting in the second lighting assembly.

With reference to FIGS. 6 and 7, a second lighting assembly 100 includes a housing 102 which is similar to the housing 12 of the first lighting assembly 10. In particular, this housing 102 has a back portion 104 with a semicircular cross section that holds a printed circuit board 106 on which a plurality of light emitting diodes 108 are mounted and electrically interconnected. A transparent front portion 110, shown in FIG. 7, attaches to the back portion 104 to enclose the light emitting diodes and printed circuit board. The housing 102 has two ends with swivel connectors to form the second lighting assembly 100 that is functionally equivalent to the first lighting assembly 10 shown in FIG. 1.

One of the swivel connectors 112 is shown in detail in the drawings. The swivel connector 112 has a rotary fitting 114 with a socket-like base 116 into which an end of the housing 102 fits and is secured thereto. A tubular, cylindrical portion 118 of the rotary fitting 114 projects from the base 116 away from the housing. The cylindrical portion 118 has an annular flange 120 extending there around thereby forming a groove 122 at the end of the cylindrical section that abuts the base 116. The remote end 130 of the cylindrical portion 118 has an enlarged portion 124 with a semicircular, arcuate notch 126 therein extending between a pair of walls which act as stops 128.

The swivel connector 112 further includes a contact cap 134 formed by a circular base plate 136 from which five fingers 138 project toward the housing. The fingers 138 are equidistantly spaced around the perimeter of the base plate 136 defining a space into which the cylindrical portion 118 of the rotary fitting 114 extends. The ends of the fingers 138, that are remote from the base plate 136 have inwardly projecting teeth 140, enter the rotary fitting's groove 122 thereby securing the those components together. As shown in FIG. 6, the base plate 136 has a pair of apertures there through into which a pair of pin-type electrical terminals 132 are secured. These terminals 132 engage electrical contacts within a standard fluorescent tube socket to apply electrical power to the lighting assembly 100.

A pair of arcuate walls 141 project from the base plate 136 within the array of fingers 138 and extend into the central opening in the exposed end of the rotary fitting's cylindrical portion 118. The arcuate walls 141 guide rotational motion between the rotary fitting 114 and the contact cap 134, as will be described. A tab 142 projects from the base plate 136 between two of the fingers 138. In the assembled swivel connector 112, the tab 142 extends into the arcuate notch 126 at one end of the cylindrical portion 118 of the rotary fitting 114. When the rotary fitting and contact cap rotate with respect to each other, the tab 142 strikes the two stops 128 to limit rotation of the swivel connector to approximately 180 degrees. This prevents excessive twisting of electrical wires (not shown) that extend through the swivel connector 112 between the electrical terminals 132 and the printed circuit board 106.

A tubular release sleeve 146 extends over the contact cap 134. Each of the fingers 138 has an exterior notch 135, all of which are aligned in a circle around the contact cap. The interior surface 148 of the release sleeve 146 has an inwardly projecting annular rib 150. The release sleeve 146 can slide longitudinally along the contact cap 134 into positions in which the interior rib 150 nests in the finger notches 135 and is outside the notched pressing the fingers 138 toward each other.

The second swivel connector 112 can be rotated at the end of the housing 102 so that the light emitted by the LED's 108 and directed through the transparent front portion 110 is emitted in the proper direction regardless of how the electrical terminals 132 are positioned within the light fixture sockets 21, 23. This rotation is accomplished by sliding the release sleeve 146 longitudinally so that the internal rib 150 enters the notches 135 in the fingers 138 of the contact cap. The interior rib 150 nesting within the notches 135 allows the fingers 138 to spring away from the rotary fitting 114. This reduces the friction between those components permitting rotation of the housing 102 and the LED's therein with respect to the contact cap 134 and the light fixture sockets 21, 23.

After the LED's have been properly aimed, the release sleeve 146 is slid against wall 115 of the rotary fitting 114. This action causes the interior rib 150 inside the release sleeve to ride out of the notches 135 and press the fingers 138 radially inward against the rotary fitting 114. This engagement of the rotary fitting by the fingers secures the rotational orientation of the housing 102 and the LED's therein with respect to the contact cap 134 and the light fixture.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A lighting assembly comprising:

a housing;

a light source mounted to the housing; and a swivel connector comprising a rotary fitting attached to the housing, a contact cap adjacent and rotatable with respect to the rotary fitting and having a coupling for engaging a light fixture, and a locking member which releasably engages at least one of the contact cap and the rotary fitting, the swivel connector further comprising a release sleeve operating the locking member to selectively enable and restrict rotation motion between the contact cap and the rotary fitting.

2. The lighting assembly as recited in claim 1 wherein one of the rotary fitting and the contact cap has a pair of stops and the other of the rotary fitting and the contact cap has an element that engages the pair of stops to limit rotation between the rotary fitting and the contact cap.

3. A lighting assembly as recited in claim 1 further comprising another swivel connector attached to the housing for engaging the light fixture in a manner that allows the housing to rotate with respect to the light fixture.

4. The lighting assembly as recited in claim 1 wherein the light source comprises a plurality of light emitting diodes.

5. The lighting assembly as recited in claim 4 wherein the plurality of light emitting diodes are within the housing and at least a portion of the housing is transparent through which light emitted by the plurality of light emitting diodes travels.

6. The lighting assembly as recited in claim 1 wherein the light source comprises a circuit board having a surface on which a plurality of light emitting diodes are mounted.

7. The lighting assembly as recited in claim 1 wherein the coupling of the contact cap is an electrical terminal for engaging a contact of the light fixture and being electrically connected to the light source.

8. The lighting assembly as recited in claim 1 wherein the locking member comprises a finger that projects from the contact cap and selectively engages the rotary fitting.

9. The lighting assembly as recited in claim 8 wherein the finger has tooth that projects into a groove in the rotary fitting.

10. The lighting assembly as recited in claim 8 wherein the release sleeve has a first position in which the release sleeve forces the finger against the rotary fitting to restrict movement between the rotary fitting and the contact cap, and has a second position in which the finger is released from the rotary fitting so that movement may occur between the rotary fitting and the contact cap.

11. The lighting assembly as recited in claim 10 wherein the finger has a notch therein; and the release sleeve has a protrusion that in the second position is within the notch in the finger and in the first position the protrusion in remote from the notch and applies force to the finger.

12. The lighting assembly as recited in claim 10 wherein the release sleeve slides along the contact cap between the first position and the second position.

13. The lighting assembly as recited in claim 1 wherein:

the locking member comprises a plurality of fingers that project from the contact cap and selectively engage the rotary fitting; and the release sleeve has a first position in which the plurality of fingers are forced against the rotary fitting to restrict movement between the rotary fitting and the contact cap, and has a second position in which the plurality of fingers released from the rotary fitting so that movement may occur between the rotary fitting and the contact cap.

14. The lighting assembly as recited in claim 13 wherein each of the plurality of fingers has tooth that projects into a groove in the rotary fitting.

15. The lighting assembly as recited in claim 1 wherein the locking member comprises a first torsion spring wound around and releasably engaging the rotary fitting, and having a first portion that engages the contact cap and has a second portion that engages the release sleeve, wherein engagement of the first torsion spring with the rotary fitting resists rotation of the housing with respect to the contact cap and wherein motion of the release sleeve relative to the contact cap loosens engagement of the torsion spring with the rotary fitting thereby enabling the housing to rotate with respect to the contact cap.

16. The lighting assembly as recited in claim 15 wherein the swivel connector further comprises a bias member biasing the contact cap with respect to the rotary fitting.

17. The lighting assembly as recited in claim 15 wherein the swivel connector further comprises a bias member biasing the release sleeve with respect to the rotary fitting.

18. The lighting assembly as recited in claim 15 wherein the locking member further comprises a second torsion spring wound around the rotary fitting, the second torsion spring having a third portion that engages the contact cap and a fourth portion that engages the release sleeve, wherein the second torsion spring releasably engages the rotary fitting to resist rotation of the housing with respect to the contact cap and wherein motion of the release sleeve relative to the contact cap loosens engagement of the second torsion spring with the rotary fitting thereby enabling the housing to rotate with respect to the contact cap.

19. A lighting assembly comprising:

a housing;

a light source mounted to the housing; and a swivel connector comprising a rotary fitting attached to the housing, a contact cap adjacent and rotatable with respect to the rotary fitting and having a coupling for engaging a light fixture, a finger that projects from the contact cap and selectively engages the rotary fitting, and a release sleeve engaging the finger to selectively enable and restrict rotation motion between the contact cap and the rotary fitting.

20. The lighting assembly as recited in claim 19 wherein the finger has tooth that projects into a groove in the rotary fitting.

21. The lighting assembly as recited in claim 19 wherein the release sleeve has a first position in which the release sleeve forces the finger against the rotary fitting to restrict movement between the rotary fitting and the contact cap, and has a second position in which the finger is released from the rotary fitting so that movement may occur between the rotary fitting and the contact cap.

22. The lighting assembly as recited in claim 21 wherein the finger has a notch therein; and the release sleeve has a protrusion that in the second position is within the notch in the finger and in the first position the protrusion in remote from the notch and applies force to the finger.

23. The lighting assembly as recited in claim 21 wherein the release sleeve slides along the contact cap between the first position and the second position.

24. The lighting assembly as recited in claim 19 wherein:

a plurality of fingers that project from the contact cap and selectively engage the rotary fitting; and the release sleeve has a first position in which the plurality of fingers are forced against the rotary fitting to restrict movement between the rotary fitting and the contact cap, and has a second position in which the plurality of fingers are released from the rotary fitting so that movement may occur between the rotary fitting and the contact cap.

25. The lighting assembly as recited in claim 24 wherein each of the plurality of fingers has tooth that projects into a groove in the rotary fitting.

26. A lighting assembly comprising:

a housing;

a light source mounted to the housing; and a first swivel connector comprising a rotary fitting attached to the housing and having a cylindrical section, a first torsion spring wound around and releasably engaging the cylindrical section, and a contact cap adjacent the rotary fitting and engaging one portion of the first torsion spring and having a member for engaging a light fixture, the first swivel connector further including a release sleeve moveably located adjacent the contact cap and engaging another portion of the first torsion spring, wherein engagement of the first torsion spring by the cylindrical section resists rotation of the housing with respect to the contact cap and wherein motion of the release sleeve relative to the contact cap loosens engagement of the first torsion spring with the cylindrical section of the rotary fitting thereby enabling the housing to rotate with respect to the contact cap.

27. The lighting assembly as recited in claim 26 wherein the light source comprises a plurality of light emitting diodes.

28. The lighting assembly as recited in claim 27 wherein the plurality of light emitting diodes are within the housing and at least a portion of the housing is transparent through which light emitted by the plurality of light emitting diodes travels.

29. The lighting assembly as recited in claim 26 wherein the member of the contact cap is an electrical terminal for engaging a contact of the light fixture and being electrically connected to the light source.

30. The lighting assembly as recited in claim 26 wherein the first swivel connector further comprises a bias member biasing the contact cap with respect to the rotary fitting.

31. The lighting assembly as recited in claim 26 wherein the first swivel connector further comprises a bias member biasing the release sleeve with respect to the rotary fitting.

32. The lighting assembly as recited in claim 26 wherein the first swivel connector further comprises a second torsion spring wound around the cylindrical section of the rotary fitting and having a first portion that engages the contact cap and a second portion that engages the release sleeve, wherein the second torsion spring releasably engages the cylindrical section of the rotary fitting to resist rotation of the housing with respect to the contact cap and wherein motion of the release sleeve relative to the contact cap loosens engagement of the second torsion spring with the cylindrical section thereby enabling the housing to rotate with respect to the contact cap.

33. A lighting assembly as recited in claim 26:

wherein the first swivel connector is attached to a first end of the housing; and further comprising a second swivel connector at a second end of the housing for engaging the light fixture in a manner that allows the housing to rotate with respect to the light fixture.

34. The lighting assembly as recited in claim 33 wherein at least one of the first connector and the second connector has an electrical terminal for engaging an electrical contact of the light fixture.

35. The lighting assembly as recited in claim 33 both of the first and second connectors further comprises an electrical terminal for engaging contacts on the light fixture.

36. The lighting assembly as recited in claim 26 wherein one of the rotary fitting and the contact cap has a pair of stops and the other of the rotary fitting and the contact cap has an element that engages the pair of stops to limit rotation between the rotary fitting and the contact cap.

* * * * *